US008784578B2

(12) United States Patent
Kawasaki et al.

(10) Patent No.: US 8,784,578 B2
(45) **Date of Patent: *Jul. 22, 2014**

(54) HIGH STRENGTH GALVANIZED STEEL SHEET WITH EXCELLENT WORKABILITY AND METHOD FOR MANUFACTURING THE SAME

(75) Inventors: Yoshiyasu Kawasaki, Fukuyama (JP); Tatsuya Nakagaito, Nagoya (JP); Shinjiro Kaneko, Fukuyama (JP); Saiji Matsuoka, Kurashiki (JP); Yasunobu Nagataki, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 145 days.

This patent is subject to a terminal disclaimer.

(21) Appl. No.: 13/203,096

(22) PCT Filed: Feb. 19, 2010

(86) PCT No.: PCT/JP2010/053020

§ 371 (c)(1),
(2), (4) Date: Nov. 4, 2011

(87) PCT Pub. No.: WO2010/098416

PCT Pub. Date: Sep. 2, 2010

(65) Prior Publication Data

US 2012/0037282 A1 Feb. 16, 2012

(30) Foreign Application Priority Data

| | | |
|---|---|---|
| Feb. 25, 2009 | (JP) | 2009-041588 |
| Mar. 30, 2009 | (JP) | 2009-080748 |
| Dec. 24, 2009 | (JP) | 2009-291832 |

(51) Int. Cl.

| | |
|---|---|
| ***B32B 15/18*** | (2006.01) |
| ***B32B 15/01*** | (2006.01) |
| ***C21D 6/00*** | (2006.01) |
| ***C23C 2/02*** | (2006.01) |

(52) U.S. Cl.
USPC ..... 148/320; 148/533; 428/457

(58) Field of Classification Search
USPC ..... 148/533, 400, 320; 428/457
See application file for complete search history.

(56) References Cited

U.S. PATENT DOCUMENTS

| | | | | |
|---|---|---|---|---|
| 6,537,394 | B1 * | 3/2003 | Osawa et al. | 148/533 |
| 2005/0016644 | A1 * | 1/2005 | Matsuoka et al. | 148/651 |
| 2008/0178972 | A1 | 7/2008 | Saito et al. | |
| 2010/0112377 | A1 | 5/2010 | Kaneko et al. | |
| 2010/0218857 | A1 * | 9/2010 | Nakagaito et al. | 148/533 |
| 2011/0008546 | A1 * | 1/2011 | Suzuki et al. | 427/431 |
| 2011/0036465 | A1 * | 2/2011 | Kawasaki et al. | 148/533 |

FOREIGN PATENT DOCUMENTS

| | | | |
|---|---|---|---|
| JP | 04026744 | | 1/1992 |
| JP | 11279691 | A | 10/1999 |
| JP | 11323494 | A | 11/1999 |
| JP | 2001140022 | A | 5/2001 |
| JP | 2001220648 | A | 8/2001 |
| JP | 2004124123 | A | 4/2004 |
| JP | 2004536965 | A | 12/2004 |
| JP | 2006265671 | A * | 10/2006 |
| JP | 2007182625 | A | 7/2007 |
| JP | 2007-211280 | A | 8/2007 |
| JP | 2008280577 | A | 11/2008 |
| WO | WO 2009054539 | A1 * | 4/2009 |
| WO | WO 2009081997 | A1 * | 7/2009 |

OTHER PUBLICATIONS

Machine translation of JP2006265671A, Oct. 2006.*
International Application Serial No. PCT/JP2010/053020, International Search Report mailed Apr. 27, 2010, 2 pgs.

* cited by examiner

*Primary Examiner* — Roy King
*Assistant Examiner* — Xiaowei Su
(74) *Attorney, Agent, or Firm* — RatnerPrestia

(57) ABSTRACT

A high strength galvanized steel sheet with excellent workability, having a component composition containing C: 0.04% or more, and 0.15% or less, Si: 0.7% or more, and 2.3% or less, Mn: 0.8% or more, and 2.2% or less, P: 0.1% or less, S: 0.01% or less, Al: 0.1% or less, N: 0.008% or less, and the remainder composed of iron and incidental impurities on a percent by mass basis, and a microstructure including 70% or more of ferrite phase, 2% or more, and 10% or less of bainite phase, and 0% or more, and 12% or less of pearlite phase on an area fraction basis and 1% or more, and 8% or less of retained austenite phase on a volume fraction basis, wherein an average crystal grain diameter of ferrite is 18 μm or less and an average crystal grain diameter of retained austenite is 2 μm or less.

9 Claims, No Drawings

HIGH STRENGTH GALVANIZED STEEL SHEET WITH EXCELLENT WORKABILITY AND METHOD FOR MANUFACTURING THE SAME

CROSS-REFERENCE TO RELATED APPLICATIONS

This application is the U.S. National Phase application of PCT International Application No. PCT/JP2010/053020, filed Feb. 19, 2010, and claims priority to Japanese Patent Application No. 2009-041588, filed Feb. 25, 2009, Japanese Patent Application No. 2009-080748, filed Mar. 30, 2009, and Japanese Patent Application No. 2009-291832, filed Dec. 24, 2009, the disclosures of which PCT and priority applications are incorporated herein by reference in their entirely for all purposes.

FIELD OF THE INVENTION

The present invention relates to a high strength galvanized steel sheet, which is suitable for a member used in industrial fields of automobile, electricity, and the like, with excellent workability and a method for manufacturing the same.

BACKGROUND OF THE INVENTION

In recent years, enhancement of fuel economy of the automobile has become an important issue from the viewpoint of global environmental conservation. Consequently, there is an active movement afoot to reduce the thickness through increases in strength of car body materials, so as to reduce the weight of a car body itself. However, an increase in strength of a steel sheet causes reduction in elongation, that is, reduction in formability. Therefore, development of materials having high strength and high workability in combination has been desired under the present circumstances.

Furthermore, in forming of the high strength steel sheet into a complicated shape, e.g., an automobile component, occurrences of cracking and necking in a punch stretch portion or a stretch flange portion cause large issues. Therefore, a high strength steel sheet which can overcome the issues on occurrences of cracking and necking and which has high elongation and high stretch flangeability in combination has also been required.

Regarding an improvement of formability of the high strength steel sheet, heretofore, various multi phase high strength galvanized steel sheets, e.g., a ferrite-martensite dual-phase steel (Dual-phase Steel) and a TRIP steel taking the advantage of the transformation induced plasticity (Transformation Induced Plasticity) of retained austenite phase, have been developed.

For example, PTLs 1 and 2 have proposed steel sheets with excellent elongation by specifying the chemical components and specifying the volume fractions of retained austenite phase and martensitic phase and methods for manufacturing the same. Moreover, PTL 3 has proposed a steel sheet with excellent elongation by specifying the chemical components and, furthermore, specifying a special method for manufacturing the same. In addition, PTL 4 has proposed a steel sheet with excellent elongation by specifying the chemical components and specifying the volume fractions of ferrite phase, bainite phase, and retained austenite phase.

PATENT LITERATURE

[PTL 1] Japanese Unexamined Patent Application Publication No. 11-279691

[PTL 2] Japanese Unexamined Patent Application Publication No. 2001-140022

[PTL 3] Japanese Unexamined Patent Application Publication No. 04-026744

[PTL 4] Japanese Unexamined Patent Application Publication No. 2007-182625

SUMMARY OF THE INVENTION

Regarding PTLs 1 to 4, the main purpose is to improve the elongation by taking the advantage of the transformation induced plasticity of retained austenite phase and, therefore, the stretch flangeability is not taken into consideration. Consequently, development of a high strength galvanized steel sheet having high elongation and high stretch flangeability in combination becomes an issue.

In consideration of the above-described circumstances, the present invention provides a high strength galvanized steel sheet having high strength (tensile strength TS of 590 MPa or more) and exhibiting excellent workability (high elongation and high stretch flangeability) and a method for manufacturing the same.

The present inventors performed intensive research to obtain a high strength galvanized steel sheet having high strength (tensile strength TS of 590 MPa or more) and exhibiting excellent workability (elongation and stretch flangeability) and found the following.

By virtue of intentional addition of Si, an improvement of elongation due to an improvement of a work hardening property of a ferrite phase, ensuring of strength due to solution hardening of a ferrite phase, and an improvement of stretch flangeability due to relaxation of hardness difference from a secondary phase became possible. Furthermore, by making the most of bainite transformation, an improvement of elongation due to stable ensuring of a retained austenite phase and an improvement of stretch flangeability due to relaxation of hardness difference, that is, the hardness difference between a soft ferrite phase and a hard martensitic phase or a retained austenite phase, through formation of a bainite phase serving as an intermediate hardness phase became possible. Moreover, if much martensitic phase was present in a final microstructure, a large hardness difference occurred at a different phase interface of the soft ferrite phase, so that the stretch flangeability was degraded. Then, a part of an untransformed austenite phase, which was transformed to a martensitic phase finally, was converted to pearlite, and a microstructure composed of a ferrite phase, a bainite phase, a pearlite phase, a martensitic phase, and a retained austenite phase was formed and, thereby, the stretch flangeability was able to be further improved while high elongation was maintained. In addition, the area fraction of each phase was controlled appropriately and, thereby, the compatibility between high elongation and high stretch flangeability was able to be ensured with respect to a steel sheet at each strength level, where the tensile strength TS was 590 MPa or more.

The present invention has been made on the basis of the above-described findings and provides the following features.

[1] A high strength galvanized steel sheet with excellent workability, characterized by having a component composition containing C: 0.04% or more, and 0.15% or less, Si: 0.7% or more, and 2.3% or less, Mn: 0.8% or more, and 2.2% or less, P: 0.1% or less, S: 0.01% or less, Al: 0.1% or less, N: 0.008% or less, and the remainder composed of iron and incidental impurities on a percent by mass basis, and a microstructure including 70% or more of ferrite phase, 2% or more, and 10% or less of bainite phase, and 0% or more, and 12% or less of pearlite phase on an area fraction basis and 1% or more, and 8% or less of retained austenite phase on a volume fraction basis, wherein an average crystal grain diameter of ferrite is 18 μm or less and an average crystal grain diameter of retained austenite is 2 μm or less.

[2] The high strength galvanized steel sheet with excellent workability, according to the above-described item [1], characterized by further containing 1% or more, and 5% or less of martensitic phase on an area fraction basis.

[3] The high strength galvanized steel sheet with excellent workability, according to the above-described item [1] or item [2], characterized by further containing at least one type of element selected from Cr: 0.05% or more, and 1.2% or less, V: 0.005% or more, and 1.0% or less, and Mo: 0.005% or more, and 0.5% or less, on a percent by mass basis, as the component composition.

[4] The high strength galvanized steel sheet with excellent workability, according to any one of the above-described items [1] to [3], characterized by further containing at least one type of element selected from Ti: 0.01% or more, and 0.1% or less, Nb: 0.01% or more, and 0.1% or less, B: 0.0003% or more, and 0.0050% or less, Ni: 0.05% or more, and 2.0% or less, and Cu: 0.05% or more, and 2.0% or less, on a percent by mass basis, as the component composition.

[5] The high strength galvanized steel sheet with excellent workability, according to any one of the above-described items [1] to [4], characterized by further containing at least one type of element selected from Ca: 0.001% or more, and 0.005% or less and REM: 0.001% or more, and 0.005% or less, on a percent by mass basis, as the component composition.

[6] The high strength galvanized steel sheet with excellent workability, according to any one of the above-described items [1] to [5], characterized in that the zinc coating is an alloyed zinc coating.

[7] A method for manufacturing a high strength galvanized steel sheet with excellent workability, characterized by including the steps of subjecting a steel slab having the component composition according to any one of the above-described items [1], [3], [4], and [5] to hot rolling, pickling, and cold rolling, performing heating to a temperature range of 650° C. or higher at an average heating rate of 8° C./s or more, followed by keeping in a temperature range of 750° C. to 900° C. for 15 to 600 s, performing cooling to a temperature range of 300° C. to 550° C. at an average cooling rate of 3° C./s to 80° C./s, followed by keeping in the temperature range of 300° C. to 550° C. for 10 to 200 s, and performing galvanization.

[8] A method for manufacturing a high strength galvanized steel sheet with excellent workability, characterized by including the steps of subjecting a steel slab having the component composition according to any one of the above-described items [1], [3], [4], and [5] to hot rolling and pickling, performing heating to a temperature range of 650° C. or higher at an average heating rate of 8° C./s or more, followed by keeping in a temperature range of 750° C. to 900° C. for 15 to 600 s, performing cooling to a temperature range of 300° C. to 550° C. at an average cooling rate of 3° C./s to 80° C./s, followed by keeping in the temperature range of 300° C. to 550° C. for 10 to 200 s, and performing galvanization.

[9] The method for manufacturing a high strength galvanized steel sheet with excellent workability, according to the above-described item [7] or item [8], characterized in that an alloying treatment of zinc coating is performed in a temperature range of 520° C. to 600° C. after the galvanization is performed.

In this regard, in the present specification, every % indicating a component of a steel is on a percent by mass basis. Furthermore, in the present invention, "high strength galvanized steel sheet" refers to a galvanized steel sheet having a tensile strength TS of 590 MPa or more.

Moreover, in the present invention, regardless of whether an alloying treatment is performed or not, steel sheets in which a zinc coating is applied to a steel sheet by a galvanization method are generically called galvanized steel sheets. That is, the galvanized steel sheets in the present invention include both galvanized steel sheets not subjected to an alloying treatment and galvanized steel sheets subjected to an alloying treatment.

According to embodiments of the present invention, a high strength galvanized steel sheet having high strength (tensile strength TS of 590 MPa or more) and exhibiting excellent workability (high elongation and high stretch flangeability) is obtained. In the case where the high strength galvanized steel sheet according to the present invention is applied to, for example, an automobile structural member, enhancement of fuel economy due to weight reduction of a car body can be facilitated. Therefore, an industrial utility value is very large.

DETAILED DESCRIPTION OF THE INVENTION

The present invention according to exemplary embodiments will be described below in detail.

In general, regarding a two-phase structure of a soft ferrite phase and a hard martensitic phase, it is known that although the elongation can be ensured, a sufficient stretch flangeability is not obtained because the hardness difference between the ferrite phase and the martensitic phase is large. Consequently, a ferrite phase has been employed as a primary phase and a bainite phase containing a carbide has been employed as a secondary phase to relax the hardness difference and ensure the stretch flangeability. However, in this case, there is a problem in that sufficient elongation cannot be ensured. Then, the present inventors further performed research on utilization of a retained austenite phase and utilization of a pearlite phase and performed detailed research taking note of the possibility of improvement in characteristics of a multi phase composed of the ferrite phase, the bainite phase, the pearlite phase, the martensitic phase, and the retained austenite phase.

As a result, compatibility between high elongation and high stretch flangeability was able to be ensured by intentional addition of Si for the purpose of solution hardening of a ferrite phase and an improvement of a work hardening property of the ferrite phase, reduction in hardness difference between different phases through formation of the multi phase composed of the ferrite phase, the bainite phase, the pearlite phase, the martensitic phase, and the retained austenite phase, and furthermore, optimization of the area of the multi phase.

The present invention has been completed on the basis of the above-described technical features.

Then, one embodiment of the present invention is characterized in that a component composition contains C: 0.04% or more, and 0.15% or less, Si: 0.7% or more, and 2.3% or less, Mn: 0.8% or more, and 2.2% or less, P: 0.1% or less, S: 0.01% or less, Al: 0.1% or less, N: 0.008% or less, and the remainder composed of iron and incidental impurities on a percent by mass basis, a microstructure includes 70% or more of ferrite phase, 2% or more, and 10% or less of bainite phase, and 0% or more, and 12% or less of pearlite phase on an area fraction basis and includes 1% or more, and 8% or less of retained austenite phase on a volume fraction basis, an average crystal grain diameter of ferrite is 18 μm or less, and an average crystal grain diameter of retained austenite is 2 μm or less.

(1) Initially, the component composition will be described.

C: 0.04% or More, and 0.15% or Less

Carbon is an austenite forming element and is an element effective in forming a multi phase and improving a balance between the strength and the elongation. If the amount of C is less than 0.04%, it is difficult to ensure a required amount of retained γ and a bainite area fraction. On the other hand, if the amount of C exceeds 0.15% and, therefore, addition is excessive, the area fraction of hard martensitic phase exceeds 5%, and the stretch flangeability is degraded. Furthermore, a welded zone and a heat-affected zone are hardened significantly, and the mechanical characteristics of the welded zone are degraded. Therefore, C is specified to be 0.04% or more, and 0.15% or less, and preferably 0.05% or more, and 0.13% or less.

Si: 0.7% or More, and 2.3% or Less

Silicon is a ferrite forming element and is also an element effective in solution hardening. In this regard, 0.7% or more of addition is preferred to improve a balance between the strength and the elongation and ensure the strength of the ferrite phase. Furthermore, 0.7% or more of addition is also preferred to ensure the retained austenite phase stably. However, excessive addition of Si causes degradation of surface properties due to an occurrence of red scale and the like, and degradation of deposition and adhesion. Therefore, Si is specified to be 0.7% or more, and 2.3% or less, and preferably 1.0% or more, and 1.8% or less.

Mn: 0.8% or More, and 2.2% or Less

Manganese is an element effective in strengthening a steel. Furthermore, Mn is an element to stabilize austenite and an element preferred for adjusting the fraction of a secondary phase. For this purpose, addition of 0.8% or more of Mn is preferred. On the other hand, if addition is excessive and exceeds 2.2%, the fraction of the secondary phase becomes excessive and it becomes difficult to ensure the ferrite area fraction. Moreover, an increase in cost is brought about because an alloy cost of Mn has increased in recent years. Therefore, Mn is specified to be 0.8% or more, and 2.2% or less, and preferably 1.0% or more, and 2.0% or less.

P: 0.1% or Less

Phosphorus is an element effective in strengthening a steel. However, if addition is excessive and exceeds 0.1%, embrittlement is caused by grain boundary segregation, and an anti-crash property is degraded. Furthermore, if 0.1% is exceeded, an alloying speed is reduced significantly. Therefore, P is specified to be 0.1% or less.

S: 0.01% or Less

Sulfur forms inclusions, e.g., MnS, to cause degradation in anti-crash property and cracking along a metal flow of a welded zone and, therefore, is minimized, although S is specified to be 0.01% or less from the viewpoint of production cost.

Al: 0.1% or Less

In the case where Al is added for deoxidation of a steel, it is preferable that the amount of addition is specified to be 0.01% or more because if the amount is less than 0.01%, a large number of coarse oxides of Mn, Si, and the like are dispersed in the steel to degrade the material properties. However, the amount of Al exceeding 0.1% leads to degradation of surface properties. Therefore, the amount of Al is specified to be 0.1% or less, and preferably 0.01% to 0.1%.

N: 0.008% or Less

Nitrogen is an element which degrades the aging resistance of a steel to a greatest extent and preferably is minimized. If 0.008% is exceeded, degradation of the aging resistance becomes significant. Therefore, N is specified to be 0.008% or less.

The remainder is composed of iron and incidental impurities. However, besides these component elements, the following alloy elements can be added.

At least one type selected from Cr: 0.05% or more, and 1.2% or less, V: 0.005% or more, and 1.0% or less, and Mo: 0.005% or more, and 0.5% or less Chromium, vanadium, and molybdenum have a function of controlling generation of pearlite during cooling from an annealing temperature and, therefore, can be added. The effect thereof is obtained when Cr: 0.05% or more, V: 0.005% or more, and Mo: 0.005% or more are employed. However, if Cr, V, and Mo are added in such a way as to exceed Cr: 1.2%, V: 1.0%, and Mo: 0.5%, respectively, the secondary layer fraction becomes too large, and degradation in stretch flangeability and the like may occur. Furthermore, an increase in cost is brought about. Therefore, in the case where these elements are added, each of the amounts thereof is specified to be Cr: 1.2% or less, V: 1.0% or less, or Mo: 0.5% or less.

Moreover, at least one type of element selected from Ti, Nb, B, Ni, and Cu described below can be contained.

Ti: 0.01% or more, and 0.1% or less, Nb: 0.01% or more, and 0.1% or less

Titanium and niobium are effective in precipitation hardening of a steel. The effect is obtained when each of them is 0.01% or more and, therefore, there is no problem in use for strengthening the steel. However, if each of them exceeds 0.1%, the workability and the shape fixability are degraded. Furthermore, an increase in cost is brought about. Therefore, in the case where Ti and Nb are added, the amount of addition of Ti is specified to be 0.01% or more, and 0.1% or less and Nb is specified to be 0.01% or more, and 0.1% or less.

B: 0.0003% or More, and 0.0050% or Less

Boron has a function of suppressing generation and growth of ferrite from austenite grain boundaries and, therefore, can be added. The effect is obtained when B is 0.0003% or more. However, if 0.0050% is exceeded, the workability is degraded. Furthermore, an increase in cost is brought about. Therefore, in the case where B is added, B is specified to be 0.0003% or more, and 0.0050% or less.

Ni: 0.05% or More, and 2.0% or Less, and Cu: 0.05% or More, and 2.0% or Less

Nickel and copper are elements effective in strengthening a steel and there is no problem in use for strengthening the steel. Furthermore, internal oxidation is facilitated so as to improve adhesion of the coating. In order to obtain these effects, it is preferred that each of Ni and Cu is 0.05% or more. On the other hand, if both Ni and Cu, each exceeding 2.0%, are added, the workability of the steel sheet is degraded. Moreover, an increase in cost is brought about. Therefore, in the case where Ni and Cu are added, the amount of addition of each of them is specified to be 0.05% or more, and 2.0% or less.

At least one type selected from Ca: 0.001% or more, and 0.005% or less and REM: 0.001% or more, and 0.005% or less Calcium and REM are elements effective in spheroidizing the shape of a sulfide to improve an adverse influence of the sulfide on the stretch flangeability. In order to obtain this effect, it is preferred that each of Ca and REM is 0.001% or more. However, excessive addition causes increases in inclusions and the like so as to cause surface and internal defects. Therefore, in the case where Ca and REM are added, the amounts of addition of each of them is specified to be 0.001% or more, and 0.005% or less.

(2) Next, a microstructure will be described.

Area Fraction of Ferrite Phase: 70% or More

In order to ensure good elongation, it is preferred that a ferrite phase is 70% or more on an area fraction basis.

Area Fraction of Bainite Phase: 2% or More, and 10% or Less.

In order to ensure good stretch flangeability, it is preferred that a bainite phase is 2% or more on an area fraction basis. Meanwhile, in order to ensure good elongation, the bainite phase is specified to be 10% or less. In this regard, the area fraction of bainite phase refers to a proportion of the area of a bainitic ferrite phase (ferrite having a high dislocation density) constituting an observation area.

Area Fraction of Pearlite Phase: 0% or More, and 12% or Less

In the case where the area fraction of pearlite phase exceeds 12%, a beneficial amount of retained austenite phase cannot be ensured and the elongation is degraded. Consequently, in order to ensure good elongation, it is preferred that the pearlite phase is 12% or less on an area fraction basis. Meanwhile, in order to ensure good stretch flangeability, it is preferable that the pearlite which relaxes the hardness difference between soft ferrite and hard martensite and which has an intermediate hardness is 2% or more. Therefore, the pearlite phase is preferably 2% or more, and 10% or less.

Volume Fraction of Retained Austenite Phase: 1% or More, and 8% or Less.

In order to ensure good elongation, it is preferred that the retained austenite phase is 1% or more on a volume fraction basis. Meanwhile, in the case where the volume fraction of retained austenite phase exceeds 8%, a hard martensitic phase, which is generated through transformation of the retained austenite phase during stretch flange working, increases and, thereby, the stretch flangeability is degraded. Therefore, in order to ensure good stretch flangeability, it is preferred that the retained austenite phase is 8% or less on a volume fraction basis. The retained austenite phase is preferably 2% or more, and 6% or less.

Average Crystal Grain Diameter of Ferrite: 18 μm or Less

In order to ensure a desired strength, it is preferred that an average crystal grain diameter of ferrite is 18 μm or less. Meanwhile, in the case where the average crystal grain diameter of ferrite exceeds 18 μm, the dispersion state of secondary phases, which are present mostly at grain boundaries of ferrite, becomes dense locally, a microstructure, in which the secondary phase are dispersed uniformly, is not obtained, and degradation in stretch flangeability may occur.

Average Crystal Grain Diameter of Retained Austenite: 2 μm or Less

In order to ensure good stretch flangeability, it is preferred that the average crystal grain diameter of retained austenite is 2 μm or less.

Area Fraction of Martensitic Phase: 1% or More, and 5% or Less

In order to ensure desired strength, it is preferred that a martensitic phase is 1% or more on an area fraction basis. Furthermore, in order to ensure good stretch flangeability, the area fraction of a hard martensitic phase is specified to be 5% or less.

In this regard, a tempered martensitic phase, a tempered bainite phase, and carbides, e.g., cementite, other than the ferrite phase, the pearlite phase, the bainite phase, the retained austenite phase, and the martensitic phase may be generated. However, the purpose of the present invention can preferably be achieved insofar as the above-described area fractions of the ferrite phase, pearlite phase and bainite phase, the volume fraction of the retained austenite phase, and the average crystal grain diameters of the ferrite and the retained austenite are satisfied.

Furthermore, the area fractions of the ferrite phase, the bainite phase (bainitic ferrite phase), the pearlite phase, and the martensitic phase refers to proportions of the areas of the individual phases constituting an observation area.

(3) Next, production conditions will be described.

The high strength galvanized steel sheet according to embodiments of the present invention can be produced by a method in which a steel slab having the component composition conforming to the above-described component composition ranges is subjected to hot rolling, pickling, and cold rolling, heating to a temperature range of 650° C. or higher is performed at an average heating rate of 8° C./s or more, followed by keeping in a temperature range of 750° C. to 900° C. for 15 to 600 s, cooling to a temperature range of 300° C. to 550° C. is performed at an average cooling rate of 3° C./s to 80° C./s, followed by keeping in the temperature range of 300° C. to 550° C. for 10 to 200 s, galvanization is performed and, as necessary, an alloying treatment of zinc coating can be performed in a temperature range of 520° C. to 600° C.

In this regard, the above description relates to the case where a substrate steel sheet of the coating is a cold-rolled steel sheet, although the substrate steel sheet of the coating can also be a steel sheet after being subjected to the above-described hot rolling and pickling.

Detailed explanation will be made below.

A steel having the above-described component composition is melted, is made into a slab through roughing or continuous casting, and is made into a hot coil through hot rolling by a usually known process. In performing hot rolling, the condition is not specifically limited, although it is preferable that the slab is heated to 1,100° C. to 1,300° C., hot rolling is performed at a final finishing temperature of 850° C. or higher, and steel sheet in coil is taken up at 400° C. to 750° C. In the case where the take-up temperature exceeds 750° C., carbides in the hot-rolled sheet may become coarse, and required strength cannot be obtained in some cases because such coarse carbides are not melted completely during soaking in short-time annealing and the like after hot rolling and pickling or after cold rolling. Subsequently, a pretreatment, e.g., pickling and debinding, is performed by usually known method and, then, cold rolling is performed. In performing the cold rolling, the condition thereof is not necessarily specifically limited, although it is preferable that the cold rolling is performed under the cold reduction ratio of 30% or more. This is because if the cold reduction ratio is low, in some cases, recrystallization of ferrite is not facilitated, unrecrystallized ferrite remains, and the elongation and the stretch flangeability are degraded.

Heating to temperature range of 650° C. or higher at average heating rate of 8° C./s or more In the case where the temperature range of heating is lower than 650° C. or the average heating rate is less than 8° C./s, a fine uniformly dispersed austenite phase is not generated during annealing, a microstructure in which a secondary phases are locally concentratively present in a final microstructure is formed, and it is difficult to ensure good stretch flangeability. Furthermore, in the case where the average heating rate is less than 8° C./s, a furnace longer than a usual furnace is necessary and, thereby, an increase in cost associated with large energy consumption and reduction in production efficiency are brought about. Meanwhile, it is preferable that DFF (Direct Fired Furnace) is used as a furnace. This is because an internal oxide layer is formed through rapid heating by the DFF and, thereby, concentration of oxides of Si, Mn, and the like on the outermost layer of the steel sheet is prevented so as to ensure good wettability of the coating.

Keeping in Temperature Range of 750° C. to 900° C. for 15 to 600 s

In embodiments of the present invention, for the purpose of annealing, keeping in a temperature range of 750° C. to 900° C., specifically in a single phase region of austenite or in a two-phase region of an austenite phase and a ferrite phase, is performed for 15 to 600 s. In the case where the annealing temperature is lower than 750° C. or the annealing time is less than 15 s, hard cementite in the steel sheet is not melted sufficiently in some cases, recrystallization of ferrite is not completed, and it becomes difficult to ensure a desired volume fraction of retained austenite phase, so that the elongation is degraded. Meanwhile, in the case where the annealing temperature exceeds 900° C. or the case where the annealing time exceeds 600 s, austenite becomes coarse during annealing and immediately after termination of cooling, most of the secondary phase becomes untransformed austenite in which C is thin. Consequently, in the downstream step of keeping in the temperature range of 300° C. to 550° C. for 10 to 200 s, bainite transformation proceeds so as to generate bainite containing carbides to a great extent, a martensitic phase and a retained austenite phase are hardly ensured, and it becomes difficult to ensure desired strength and good elongation. Moreover, an increase in cost associated with large energy consumption may be brought about.

Cooling to Temperature Range of 300° C. to 550° C. at Average Cooling Rate of 3° C./s to 80° C./s In the case where the average cooling rate is less than 3° C./s, most of the secondary phase is converted to pearlite or cementite during cooling, and finally, retained austenite phase can hardly be ensured, so that the elongation is degraded. In the case where the average cooling rate exceeds 80° C./s, generation of ferrite is not sufficient, a desired ferrite area fraction is not obtained, and the elongation is degraded. In particular, in the case where an alloying treatment is not performed after galvanization, it is preferable that an upper limit of the average cooling rate is specified to be 15° C./s from the viewpoint of obtainment of a desired microstructure. Meanwhile, in the case where the cooling termination temperature is lower than 300° C., bainite transformation is not facilitated, and a microstructure in which a bainite phase and a retained austenite phase are hardly present results, so that desired elongation is not obtained. In the case where the cooling termination temperature exceeds 550° C., most of the untransformed austenite is converted to cementite or pearlite, and it becomes difficult to obtain aimed area fraction of bainite phase and volume fraction of retained austenite phase, so that the elongation is degraded.

Keeping in temperature range of 300° C. to 550° C. for 10 to 200 s

In the case where the keeping temperature is lower than 300° C. or exceeds 550° C. or the case where the keeping time is less than 10 s, bainite transformation is not facilitated, and a microstructure in which a bainite phase and a retained austenite phase are hardly present results, so that desired elongation is not obtained. Furthermore, in the case where the keeping time exceeds 200 s, bainite transformation is facilitated excessively and, thereby, most of the secondary phase is converted to a bainite phase and cementite. Consequently, a final microstructure becomes a microstructure which hardly contains martensite and it becomes difficult to ensure desired strength.

Thereafter, the steel sheet is dipped into a coating bath at a usual bath temperature so as to perform galvanization, and the amount of deposition is adjusted through gas wiping or the like.

Alloying treatment of zinc coating in temperature range of 520° C. to 600° C.

For the purpose of improvement of corrosion resistance, the surface is subjected to a galvanizing treatment. In that case, in order to ensure the press formability, the spot weldability, and the adhesion of the paint, galvannealing is used frequently, wherein a heat treatment is performed after coating so as to diffuse Fe in the steel sheet into the coating layer. It is advantageous in the present invention that an alloying treatment of zinc coating is performed in this temperature range. Regarding an untransformed austenite which is generated by facilitating bainite transformation and which contains a large amount of solid solution C, the amount of pearlite transformation (or conversion to cementite) is small and stable retained austenite phase remains to a great extent even when heated to the above-described temperature range by an alloying treatment, whereas most of untransformed austenite which contains a small amount of solid solution C undergoes pearlite transformation (or conversion to cementite) when heated to the above-described temperature range. In the case where the alloying treatment temperature is higher than 600° C., a final microstructure becomes a microstructure in which a ferrite phase, a pearlite phase, and a bainite phase constitute most part and a retained austenite phase and a martensitic phase are hardly present, and it becomes difficult to ensure desired strength and good elongation. Meanwhile, in the case where the alloying treatment temperature is lower than 520° C., untransformed austenite which contains a small amount of solid solution C is finally transformed to martensite while the amount of conversion to pearlite is small. That is, the final microstructure is formed from the ferrite phase, the bainite phase, the retained austenite phase, and 5% or more of martensitic phase, different phase interfaces, at which a hardness difference between the above-described soft ferrite phase and the hard martensitic phase is large, increase significantly, and the stretch flangeability is degraded. Then, for the purpose of reducing the hard martensitic phase in the final microstructure, the alloying treatment is performed in a high temperature range of 520° C. to 600° C. and, thereby, the configuration of the final microstructure is specified to be the ferrite phase, the pearlite phase, the bainite phase, the retained austenite phase, and a small amount, 5% or less, of martensitic phase, so that it becomes possible to further improve the stretch flangeability while good elongation is ensured.

In the case where the alloying treatment temperature is lower than 520° C., the area fraction of martensitic phase exceeds 5%, and the above-described hard martensitic phase is adjacent to the soft ferrite phase. Therefore, a large hardness difference occurs between different phases, and the stretch flangeability is degraded. Furthermore, deposition of the galvanized layer is degraded. In the case where the alloying treatment temperature exceeds 600° C., most of the untransformed austenite is converted to cementite or pearlite and, as a result, a desired amount of retained austenite phase cannot be ensured and the elongation is degraded. In this regard, it is more preferable that the temperature range of the alloying treatment is in the range of 540° C. to 590° C. in order to ensure the compatibility between good elongation and good stretch flangeability.

By the way, regarding a series of heat treatments in the manufacturing method according to embodiments of the present invention, the keeping temperature is not necessary constant insofar as the temperature is in the above-described range. Furthermore, even in the case where the cooling rate is changed during cooling, the gist of the present invention is not impaired insofar as the rate is in the specified range. Moreover, the steel sheet may be subjected to a heat treatment by any equipment insofar as only the heat history is satisfied. In addition, it is also in the scope of the present invention that the steel sheet is subjected to temper rolling after the heat treatment for the purpose of shape correction. In this regard, it is assumed that a steel raw material is produced through usual steps of steel making, casting, and hot rolling. However, the steel raw material may be produced through thin wall casting or the like, where a part of or whole hot rolling step is omitted.

EXAMPLE 1

A steel having a component composition shown in Table 1, where the remainder was composed of Fe and incidental impurities, was melted with a converter, and a slab was produced by a continuous casting method. The resulting slab was heated to 1,200° C., hot rolling to a sheet thickness of 3.2 mm was performed at a finish temperature of 870° C. to 920° C., and take up was performed at 520° C. Subsequently, the resulting hot-rolled steel sheet was pickled. Thereafter, cold rolling was performed so as to produce a cold-rolled steel sheet. Then, cold-rolled steel sheet obtained as described above was subjected to an annealing treatment and a galvanizing treatment with a continuous galvanization line under the production condition shown in Table 2. Subsequently, a galvannealing treatment including a heat treatment at 520° C. to 600° C. was further performed, so as to obtain a galvannealed steel sheet. Regarding a part of steel sheets, galvanized steel sheets not subjected to a galvannealing treatment were produced.

Furthermore, a steel having a component composition indicated by A, J, B, K, L, M, N, O, or P shown in Table 1, where the remainder was composed of Fe and incidental impurities, was melted with a converter, and a slab was produced by a continuous casting method. The resulting slab was heated to 1,200° C., hot rolling to a predetermined sheet thickness was performed at a finish temperature of 870° C. to 920° C., and take up was performed at 520° C. Subsequently, the resulting hot-rolled steel sheet was pickled. Thereafter, an annealing treatment and a galvanizing treatment were performed with a continuous galvanization line under the production condition shown in Table 3. Then, a galvannealing treatment including a heat treatment at 520° C. to 600° C. was further performed, so as to obtain a galvannealed steel sheet. Regarding a part of steel sheets, galvanized steel sheets not subjected to a galvannealing treatment were produced.

In this regard, in Table 3, as for Nos. 39, 40, 43, 44, 45, 49, and 54, hot rolling up to a sheet thickness of 2.6 mm was performed, as for Nos. 41, 46, 47, 50, and 53, up to a sheet thickness of 2.3 mm, as for Nos. 42 and 48, up to a sheet thickness of 2.0 mm, as for No. 51, up to a sheet thickness of 2.4 mm, and as for No. 52, up to a sheet thickness of 1.9 mm.

TABLE 1

| Steel | Chemical component (percent by mass) | | | | | | | | | | | | | | | | | |
|---|---|---|---|---|---|---|---|---|---|---|---|---|---|---|---|---|---|---|
| type | C | Si | Mn | Al | P | S | N | Ni | Cu | Cr | V | Mo | Nb | Ti | B | Ca | REM | Remarks |
| A | 0.084 | 1.51 | 1.41 | 0.031 | 0.009 | 0.0014 | 0.0031 | — | — | — | — | — | — | — | — | — | — | Invention example |
| B | 0.102 | 1.21 | 1.58 | 0.033 | 0.012 | 0.0018 | 0.0036 | — | — | — | — | — | — | — | — | — | — | Invention example |
| C | 0.052 | 1.51 | 1.83 | 0.039 | 0.021 | 0.0028 | 0.0040 | — | — | — | — | — | — | — | — | — | — | Invention example |
| D | 0.163 | 1.52 | 1.80 | 0.038 | 0.021 | 0.0036 | 0.0041 | — | — | — | — | — | — | — | — | — | — | Comparative example |
| E | 0.011 | 1.69 | 1.75 | 0.031 | 0.026 | 0.0032 | 0.0038 | — | — | — | — | — | — | — | — | — | — | Comparative example |
| F | 0.102 | 2.62 | 1.82 | 0.040 | 0.011 | 0.0042 | 0.0032 | — | — | — | — | — | — | — | — | — | — | Comparative example |
| G | 0.072 | 0.41 | 1.99 | 0.032 | 0.023 | 0.0023 | 0.0039 | — | — | — | — | — | — | — | — | — | — | Comparative example |
| H | 0.068 | 1.31 | 2.34 | 0.028 | 0.018 | 0.0022 | 0.0038 | — | — | — | — | — | — | — | — | — | — | Comparative example |
| I | 0.098 | 1.32 | 0.46 | 0.031 | 0.012 | 0.0030 | 0.0038 | — | — | — | — | — | — | — | — | — | — | Comparative example |
| J | 0.079 | 1.46 | 1.22 | 0.030 | 0.018 | 0.0029 | 0.0032 | — | — | 0.21 | — | — | — | — | — | — | — | Invention example |
| K | 0.098 | 1.34 | 1.32 | 0.030 | 0.018 | 0.0029 | 0.0032 | — | — | — | 0.05 | — | — | — | — | — | — | Invention example |
| L | 0.072 | 1.38 | 1.31 | 0.025 | 0.013 | 0.0021 | 0.0032 | — | — | — | — | 0.048 | — | — | — | — | — | Invention example |
| M | 0.081 | 1.49 | 1.43 | 0.026 | 0.008 | 0.0025 | 0.0032 | — | — | — | — | — | 0.029 | — | — | — | — | Invention example |
| N | 0.086 | 1.45 | 1.31 | 0.032 | 0.010 | 0.0034 | 0.0032 | — | — | — | — | — | — | 0.021 | 0.0012 | — | — | Invention example |
| O | 0.089 | 1.55 | 1.23 | 0.032 | 0.015 | 0.0028 | 0.0032 | 0.11 | 0.10 | — | — | — | — | — | — | — | — | Invention example |
| P | 0.081 | 1.52 | 1.39 | 0.034 | 0.009 | 0.0032 | 0.0040 | — | — | — | — | — | — | — | — | 0.001 | 0.002 | Invention example |
| Q | 0.131 | 1.36 | 1.62 | 0.031 | 0.010 | 0.0026 | 0.0031 | — | — | — | — | — | — | — | — | — | — | Invention example |
| R | 0.098 | 1.56 | 2.11 | 0.024 | 0.016 | 0.0023 | 0.0032 | — | — | — | — | — | — | — | — | — | — | Invention example |

Underlined portion: out of the scope of the present invention.

TABLE 2

| No. | Steel type | Heating temperature ° C. | Heating rate ° C./s | Annealing temperature ° C. | Annealing time s | Cooling rate ° C./s | Cooling termination temperature ° C. | Average keeping temperature until dipping into coating bath after cooling ° C. | Keeping time until dipping into coating bath after cooling s | Alloying temperature ° C. | Remarks |
|---|---|---|---|---|---|---|---|---|---|---|---|
| 1 | A | 750 | 12 | 850 | 180 | 10 | 520 | 490 | 50 | 560 | Invention example |
| 2 | A | 755 | 14 | 830 | 200 | 5 | 500 | 480 | 60 | — | Invention example |
| 3 | A | 720 | 3 | 860 | 180 | 10 | 540 | 510 | 60 | 540 | Comparative example |
| 4 | A | 750 | 12 | 680 | 210 | 11 | 530 | 500 | 90 | 550 | Comparative example |
| 5 | A | 750 | 14 | 930 | 230 | 8 | 520 | 480 | 45 | 570 | Comparative example |
| 6 | B | 745 | 13 | 840 | 180 | 13 | 500 | 490 | 45 | 565 | Invention example |
| 7 | B | 755 | 10 | 820 | 800 | 11 | 540 | 510 | 70 | 555 | Comparative example |
| 8 | B | 730 | 12 | 850 | 6 | 9 | 510 | 490 | 80 | 535 | Comparative example |
| 9 | B | 750 | 13 | 845 | 200 | 1 | 480 | 480 | 50 | 550 | Comparative example |
| 10 | B | 720 | 10 | 855 | 160 | 10 | 640 | 610 | 80 | 560 | Comparative example |
| 11 | B | 765 | 11 | 870 | 190 | 20 | 130 | 120 | 90 | 550 | Comparative example |
| 12 | C | 740 | 14 | 855 | 190 | 12 | 520 | 500 | 55 | 570 | Invention example |
| 13 | C | 810 | 14 | 820 | 220 | 18 | 490 | 480 | 3 | 540 | Comparative example |
| 14 | C | 780 | 12 | 855 | 180 | 14 | 540 | 500 | 550 | 570 | Comparative example |
| 15 | C | 770 | 16 | 800 | 220 | 25 | 530 | 490 | 60 | 650 | Comparative example |
| 16 | C | 760 | 11 | 820 | 200 | 45 | 430 | 420 | 160 | 490 | Comparative example |
| 17 | D | 750 | 10 | 830 | 200 | 12 | 510 | 470 | 65 | 530 | Comparative example |
| 18 | E | 720 | 17 | 815 | 195 | 10 | 520 | 500 | 105 | 580 | Comparative example |
| 19 | F | 690 | 16 | 840 | 160 | 9 | 490 | 480 | 55 | 595 | Comparative example |
| 20 | G | 750 | 10 | 850 | 180 | 11 | 480 | 480 | 65 | 555 | Comparative example |
| 21 | H | 710 | 12 | 850 | 230 | 12 | 540 | 520 | 50 | 550 | Comparative example |
| 22 | I | 710 | 12 | 845 | 210 | 11 | 500 | 500 | 60 | 560 | Comparative example |
| 23 | J | 750 | 10 | 860 | 180 | 10 | 530 | 490 | 110 | 550 | Invention example |
| 24 | K | 715 | 9 | 820 | 200 | 12 | 500 | 480 | 60 | 545 | Invention example |
| 25 | L | 720 | 20 | 830 | 160 | 14 | 480 | 470 | 70 | 570 | Invention example |
| 26 | M | 750 | 18 | 880 | 180 | 10 | 490 | 490 | 40 | 540 | Invention example |
| 27 | N | 730 | 15 | 825 | 210 | 9 | 520 | 405 | 60 | 550 | Invention example |
| 28 | O | 765 | 22 | 830 | 150 | 25 | 510 | 500 | 120 | 545 | Invention example |
| 29 | P | 690 | 18 | 840 | 240 | 18 | 505 | 500 | 55 | 555 | Invention example |
| 30 | A | 740 | 12 | 850 | 160 | 40 | 520 | 490 | 50 | 560 | Invention example |
| 31 | A | 710 | 10 | 825 | 200 | 60 | 500 | 480 | 60 | 555 | Invention example |
| 32 | A | 750 | 17 | 820 | 180 | 12 | 420 | 400 | 70 | 565 | Invention example |
| 33 | A | 710 | 16 | 845 | 220 | 10 | 320 | 410 | 60 | 535 | Invention example |
| 34 | A | 745 | 12 | 810 | 190 | 25 | 410 | 405 | 80 | 560 | Invention example |
| 35 | A | 720 | 14 | 840 | 200 | 55 | 400 | 400 | 90 | 540 | Invention example |
| 36 | A | 750 | 12 | 860 | 180 | 5 | 410 | 405 | 80 | — | Invention example |

TABLE 2-continued

| No. | Steel type | Heating temperature ° C. | Heating rate ° C./s | Annealing temperature ° C. | Annealing time s | Cooling rate ° C./s | Cooling termination temperature ° C. | Average keeping temperature until dipping into coating bath after cooling ° C. | Keeping time until dipping into coating bath after cooling s | Alloying temperature ° C. | Remarks |
|---|---|---|---|---|---|---|---|---|---|---|---|
| 37 | Q | 740 | 14 | 850 | 150 | 20 | 415 | 400 | 60 | 560 | Invention example |
| 38 | R | 750 | 13 | 860 | 180 | 35 | 390 | 400 | 80 | 550 | Invention example |

Underlined portion: out of the scope of the present invention.

TABLE 3

| No. | Steel type | Heating temperature ° C. | Heating rate ° C./s | Annealing temperature ° C. | Annealing time s | Cooling rate ° C./s | Cooling termination temperature ° C. | Average keeping temperature until dipping into coating bath after cooling ° C. | Keeping time until dipping into coating bath after cooling s | Alloying temperature ° C. | Remarks |
|---|---|---|---|---|---|---|---|---|---|---|---|
| 39 | A | 730 | 9 | 850 | 210 | 6 | 510 | 495 | 90 | 550 | Invention example |
| 40 | A | 740 | 10 | 840 | 220 | 5 | 520 | 490 | 80 | — | Invention example |
| 41 | A | 750 | 11 | 840 | 230 | 5 | 500 | 485 | 100 | 545 | Invention example |
| 42 | A | 740 | 11 | 850 | 210 | 6 | 510 | 495 | 90 | 555 | Invention example |
| 43 | A | 720 | 9 | 700 | 210 | 6 | 510 | 495 | 90 | 550 | Comparative example |
| 44 | A | 700 | 9 | 830 | 5 | 5 | 500 | 485 | 105 | 560 | Comparative example |
| 45 | J | 710 | 10 | 850 | 230 | 6 | 520 | 495 | 90 | 545 | Invention example |
| 46 | J | 730 | 11 | 830 | 190 | 5 | 510 | 490 | 110 | 550 | Invention example |
| 47 | J | 710 | 10 | 840 | 200 | 5 | 500 | 485 | 100 | 470 | Comparative example |
| 48 | B | 730 | 10 | 840 | 190 | 5 | 520 | 500 | 90 | 555 | Invention example |
| 49 | K | 725 | 9 | 850 | 230 | 5 | 500 | 480 | 100 | 550 | Invention example |
| 50 | L | 750 | 10 | 830 | 210 | 5 | 490 | 485 | 110 | 560 | Invention example |
| 51 | M | 740 | 11 | 850 | 200 | 5 | 500 | 490 | 110 | 540 | Invention example |
| 52 | N | 730 | 10 | 840 | 180 | 5 | 515 | 500 | 80 | 545 | Invention example |
| 53 | O | 735 | 9 | 810 | 200 | 5 | 510 | 495 | 90 | 550 | Invention example |
| 54 | P | 750 | 9 | 860 | 210 | 5 | 520 | 500 | 120 | 555 | Invention example |

Underlined portion: out of the scope of the present invention.

Regarding the resulting galvanized steel sheet, the area fractions of a ferrite phase, a bainite phase, a pearlite phase, and a martensitic phase were determined by polishing a sheet thickness cross-section parallel to a rolling direction of the steel sheet, followed by corroding with 3% nital, and observing 10 visual fields with SEM (scanning electron microscope) under a magnification of 2,000 times through the use of Image-Pro of Media Cybernetics, Inc. The average crystal grain diameter of ferrite was determined by determining areas of individual ferrite grains through the use of Image-Pro described above, calculating equivalent circle diameters, and averaging those values.

Furthermore, the volume fraction of retained austenite phase was determined on the basis of integrated intensity of ferrite and austenite peaks of a face at one-quarter sheet thickness, where the steel sheet was polished up to the one-quarter face in the sheet thickness direction. Regarding the incident X-rays, X-ray diffractometer using Co—Kα was used, the intensity ratios were determined with respect to all combinations of integrated intensities of peaks of {200}, {220}, and {311} faces of retained austenite phase and {220}, {200}, and {211} faces of ferrite phase, and the average value of them was taken as the volume fraction of retained austenite phase. The average crystal grain diameter of retained austenite was determined by observing 10 or more retained austenite with TEM (transmission electron microscope) and averaging the crystal grain diameters.

Moreover, a tensile test was performed on the basis of JIS Z2241 by using JIS No. 5 test piece, where sample was taken in such a way that a tensile direction becomes in the direction orthogonal to the rolling direction of the steel sheet, and TS (tensile strength) and El (total elongation) were measured.

In this regard, the case of TS×El≥20,000 (MPa·%) was evaluated as good.

In addition, regarding the galvanized steel sheet (GI steel sheet, GA steel sheet) obtained as described above, the stretch flangeability (hole expansion property) was measured. The stretch flangeability (hole expansion property) was measured on the basis of the Japan Iron and Steel Federation Standard JFST1001. Each of the resulting steel sheets was cut into 100 mm×100 mm, and a hole having a diameter of 10 mm was punched with a clearance of 12%±1% when sheet thickness ≥2.0 mm and with a clearance of 12%±2% when sheet thickness <2.0 mm. Thereafter, a 60° cone punch was pushed into the hole while being held with a blank holder pressure of 9 ton by using a dice having an inside diameter of 75 mm, a hole diameter at the limit of occurrence of cracking was measured, a critical hole expansion ratio λ (%) was determined from the following formula, and the hole expansion property was evaluated on the basis of the value of the resulting critical hole expansion ratio.

$$\text{critical hole expansion ratio } \lambda(\%)=\{(D_f-D_0)/D_0\}\times 100$$

where $D_f$ represents a hole diameter (mm) when cracking occurred and $D_0$ represents an initial hole diameter (mm).

In this regard, the case of λ≥70(%) was evaluated as good.

Meanwhile, regarding the r value, JIS Z2201 No. 5 test piece was cut from each of the L direction (rolling direction), the D direction (direction at 45° with respect to the rolling direction), and the C direction (direction at 90° with respect to the rolling direction) of the galvanized steel sheet, and $r_L$, $r_D$, and $r_C$, respectively, was determined on the basis of JIS Z2254, and the r value was calculated from the following formula (1).

$$r\text{ value}=(r_L+2r_D+r_C)/4 \quad (1)$$

Furthermore, regarding a deep draw forming test, a cylindrical drawing test was performed, and deep drawability was evaluated on the basis of a limit drawing ratio (LDR). Regarding the condition of the cylindrical deep drawing test, a cylindrical punch having a diameter of 33 mm was used for the test, and a mold with dice diameter: 33+3×sheet thickness mm was used. The test was performed at a blank holder pressure: 1 ton and a forming speed of 1 mm/s. The sliding state of the surface was changed depending on the coating state and the like and, therefore, in order to avoid the influence of the sliding state on the test, the test was performed under a highly lubricating condition state while a polyethylene sheet was disposed between the sample and the dice. The blank diameter was changed at 1 mm pitch, and the ratio (D/d) of the blank diameter D, which was drawn without breaking, to the punch diameter d was taken as LDR.

The thus obtained results are shown in Table 4 and Table 5.

TABLE 4

| No. | Steel type | Sheet thickess (mm) | Area fraction of α phase (%) | Area fraction of B phase (%) | Area fraction of P phase (%) | Area fraction of M phase (%) | Volume fraction of retained γ phase (%) | Average grain diameter of α phase (μm) |
|---|---|---|---|---|---|---|---|---|
| 1 | A | 1.4 | 83.9 | 4.5 | 6.7 | 2.0 | 2.1 | 9 |
| 2 | A | 1.6 | 84.1 | 3.2 | 6.3 | 1.8 | 3.9 | 10 |
| 3 | A | 1.4 | 81.2 | 5.7 | 5.7 | 3.2 | 2.8 | 9 |
| 4 | A | 1.6 | 86.6 | 1.2 | 7.7 | 2.4 | 0.6 | 12 |
| 5 | A | 1.2 | 81.3 | 3.8 | 8.6 | 0.4 | 0.7 | 14 |
| 6 | B | 1.4 | 82.4 | 5.8 | 6.0 | 1.3 | 3.9 | 9 |
| 7 | B | 1.2 | 83.1 | 4.2 | 7.7 | 0.8 | 0.9 | 10 |
| 8 | B | 1.6 | 86.8 | 1.1 | 8.8 | 2.1 | 0.5 | 13 |
| 9 | B | 1.4 | 89.2 | 0.2 | 9.6 | 0.1 | 0.2 | 11 |
| 10 | B | 1.4 | 84.2 | 0.6 | 9.3 | 3.4 | 0.7 | 13 |
| 11 | B | 1.2 | 81.8 | 1.5 | 4.3 | 8.2 | 0.3 | 8 |
| 12 | C | 1.4 | 83.8 | 3.6 | 7.3 | 1.5 | 3.1 | 12 |
| 13 | C | 1.4 | 84.9 | 0.2 | 8.1 | 4.6 | 0.1 | 8 |
| 14 | C | 1.2 | 79.9 | 7.3 | 3.2 | 0.4 | 0.7 | 11 |
| 15 | C | 1.2 | 82.9 | 4.5 | 10.6 | 0.3 | 0.1 | 9 |
| 16 | C | 2.2 | 75.6 | 11.8 | 1.4 | 6.9 | 4.1 | 10 |
| 17 | D | 1.4 | 74.8 | 7.2 | 5.9 | 5.3 | 4.2 | 7 |
| 18 | E | 1.4 | 91.9 | 0.3 | 3.0 | 2.6 | 0.1 | 19 |
| 19 | F | 1.6 | 82.1 | 5.1 | 0.2 | 2.1 | 6.6 | 17 |
| 20 | G | 1.2 | 85.3 | 3.1 | 3.1 | 7.1 | 0.3 | 13 |
| 21 | H | 1.2 | 68.9 | 5.2 | 8.1 | 11.1 | 4.1 | 6 |
| 22 | I | 1.4 | 82.6 | 2.3 | 12.6 | 1.1 | 0.8 | 15 |
| 23 | J | 1.2 | 82.3 | 4.6 | 6.4 | 2.2 | 3.6 | 13 |
| 24 | K | 1.4 | 83.9 | 5.2 | 6.0 | 1.1 | 3.2 | 8 |
| 25 | L | 1.4 | 82.4 | 6.1 | 5.4 | 1.6 | 3.0 | 10 |
| 26 | M | 1.6 | 84.0 | 3.8 | 6.9 | 1.8 | 2.8 | 8 |
| 27 | N | 1.4 | 83.6 | 5.1 | 5.7 | 2.5 | 2.3 | 9 |
| 28 | O | 1.2 | 82.2 | 5.5 | 6.2 | 1.4 | 2.9 | 12 |
| 29 | P | 1.4 | 80.9 | 5.9 | 6.6 | 2.1 | 3.7 | 11 |
| 30 | A | 1.0 | 83.9 | 5.0 | 4.6 | 1.8 | 3.8 | 9 |
| 31 | A | 1.4 | 82.1 | 5.6 | 5.4 | 2.2 | 4.0 | 10 |
| 32 | A | 1.6 | 82.2 | 5.9 | 4.3 | 2.1 | 5.1 | 10 |
| 33 | A | 1.8 | 82.4 | 6.1 | 4.1 | 1.6 | 5.2 | 11 |
| 34 | A | 2.0 | 81.1 | 6.5 | 3.7 | 2.8 | 4.9 | 10 |
| 35 | A | 1.6 | 81.7 | 6.8 | 3.5 | 2.1 | 5.1 | 9 |
| 36 | A | 1.4 | 82.3 | 7.8 | 2.2 | 1.8 | 5.8 | 8 |
| 37 | Q | 1.4 | 75.8 | 8.3 | 6.7 | 4.1 | 4.1 | 7 |
| 38 | R | 1.6 | 74.9 | 8.1 | 7.4 | 4.2 | 3.4 | 6 |

TABLE 4-continued

| No. | Average grain diameter of retained γ (μm) | TS (MPa) | El (%) | λ (%) | TS × El (MPa · %) | r value | LDR | Remarks |
|---|---|---|---|---|---|---|---|---|
| 1 | 0.9 | 628 | 33.9 | 118 | 21289 | 0.98 | 2.12 | Invention example |
| 2 | 1.1 | 635 | 34.9 | 102 | 22162 | 0.99 | 2.15 | Invention example |
| 3 | 2.4 | 597 | 32.2 | 51 | 19223 | 1.01 | 2.12 | Comparative example |
| 4 | 0.5 | 599 | 27.7 | 92 | 16592 | 0.99 | 2.03 | Comparative example |
| 5 | 1.8 | 580 | 26.5 | 95 | 15370 | 1.00 | 2.03 | Comparative example |
| 6 | 1.3 | 645 | 34.8 | 103 | 22446 | 1.00 | 2.15 | Invention example |
| 7 | 1.9 | 552 | 28.1 | 99 | 15511 | 1.01 | 2.03 | Comparative example |
| 8 | 0.7 | 603 | 26.8 | 86 | 16160 | 1.00 | 2.03 | Comparative example |
| 9 | 0.2 | 605 | 25.9 | 84 | 15670 | 1.01 | 2.03 | Comparative example |
| 10 | 0.2 | 620 | 25.8 | 89 | 15996 | 1.00 | 2.06 | Comparative example |
| 11 | 0.3 | 631 | 25.0 | 81 | 15775 | 1.03 | 2.03 | Comparative example |
| 12 | 1.2 | 618 | 35.7 | 111 | 22063 | 0.98 | 2.12 | Invention example |
| 13 | 0.3 | 658 | 24.2 | 82 | 15924 | 1.00 | 2.00 | Comparative example |
| 14 | 0.8 | 609 | 28.9 | 84 | 17600 | 0.99 | 2.06 | Comparative example |
| 15 | 0.3 | 601 | 25.8 | 121 | 15506 | 1.02 | 2.03 | Comparative example |
| 16 | 1.1 | 645 | 32.1 | 61 | 20705 | 0.99 | 2.09 | Comparative example |
| 17 | 3.1 | 705 | 29.0 | 63 | 20445 | 1.01 | 2.09 | Comparative example |
| 18 | 0.1 | 559 | 26.7 | 85 | 14925 | 0.97 | 2.00 | Comparative example |
| 19 | 2.4 | 760 | 28.7 | 64 | 21812 | 0.98 | 2.12 | Comparative example |
| 20 | 0.4 | 596 | 26.4 | 69 | 15734 | 0.99 | 2.03 | Comparative example |
| 21 | 1.1 | 689 | 24.2 | 78 | 16674 | 1.01 | 2.12 | Comparative example |
| 22 | 0.4 | 548 | 25.9 | 93 | 14193 | 1.03 | 2.06 | Comparative example |
| 23 | 0.5 | 640 | 35.2 | 108 | 22528 | 0.98 | 2.15 | Invention example |
| 24 | 0.9 | 636 | 35.0 | 101 | 22260 | 0.97 | 2.12 | Invention example |
| 25 | 1.1 | 642 | 35.8 | 107 | 22984 | 1.01 | 2.12 | Invention example |
| 26 | 0.6 | 612 | 37.2 | 101 | 22766 | 0.98 | 2.12 | Invention example |
| 27 | 1.2 | 634 | 36.4 | 111 | 23078 | 0.99 | 2.12 | Invention example |
| 28 | 0.9 | 641 | 35.9 | 98 | 23012 | 1.02 | 2.12 | Invention example |
| 29 | 0.8 | 624 | 37.1 | 120 | 23150 | 1.01 | 2.15 | Invention example |
| 30 | 0.9 | 637 | 35.4 | 122 | 22550 | 0.98 | 2.15 | Invention example |
| 31 | 1.1 | 640 | 35.8 | 128 | 22912 | 1.00 | 2.15 | Invention example |
| 32 | 1.0 | 626 | 36.5 | 106 | 22849 | 0.99 | 2.15 | Invention example |
| 33 | 1.2 | 622 | 36.7 | 110 | 22827 | 1.01 | 2.15 | Invention example |
| 34 | 1.1 | 633 | 36.6 | 122 | 23168 | 0.98 | 2.18 | Invention example |
| 35 | 1.0 | 635 | 36.9 | 130 | 23432 | 0.99 | 2.18 | Invention example |
| 36 | 1.3 | 652 | 37.0 | 96 | 24124 | 1.00 | 2.21 | Invention example |
| 37 | 1.4 | 812 | 27.8 | 72 | 22574 | 0.99 | 2.18 | Invention example |

TABLE 4-continued

| | | | | | | | | | |
|---|---|---|---|---|---|---|---|---|---|
| | 38 | 1.5 | 821 | 26.9 | 78 | 22085 | 0.97 | 2.15 | Invention example |

Underlined portion: out of the scope of the present invention.

α: ferrite, B: bainite, P: pearlite, M: martensite, γ austenite

TABLE 5

| No. | Steel type | Sheet thickness (mm) | Area fraction of α phase (%) | Area fraction of B phase (%) | Area fraction of P phase (%) | Area fraction of M phase (%) | Volume fraction of retained γ phase (%) | Average grain diameter of α phase (μm) |
|---|---|---|---|---|---|---|---|---|
| 39 | A | 2.6 | 86.6 | 3.8 | 5.4 | 2.0 | 1.6 | 14 |
| 40 | A | 2.6 | 84.9 | 5.2 | 2.4 | 3.5 | 3.2 | 13 |
| 41 | A | 2.3 | 86.2 | 4.2 | 5.6 | 1.8 | 1.8 | 12 |
| 42 | A | 2.0 | 86.8 | 4.5 | 4.9 | 1.9 | 1.5 | 12 |
| 43 | A | 2.6 | 86.5 | 1.3 | 7.1 | 3.4 | 0.5 | 14 |
| 44 | A | 2.6 | 86.9 | 1.1 | 6.8 | 3.6 | 0.6 | 13 |
| 45 | J | 2.6 | 84.2 | 5.1 | 6.9 | 1.7 | 1.6 | 14 |
| 46 | J | 2.3 | 84.9 | 4.8 | 6.1 | 2.0 | 1.8 | 13 |
| 47 | J | 2.3 | 76.5 | 10.6 | 1.2 | 6.0 | 4.2 | 13 |
| 48 | B | 2.0 | 85.1 | 3.8 | 6.1 | 2.2 | 2.2 | 13 |
| 49 | K | 2.6 | 85.9 | 3.6 | 5.4 | 1.8 | 1.6 | 14 |
| 50 | L | 2.3 | 84.2 | 5.2 | 5.6 | 2.6 | 1.8 | 12 |
| 51 | M | 2.4 | 84.3 | 4.8 | 4.9 | 3.1 | 1.9 | 13 |
| 52 | N | 1.9 | 82.6 | 6.1 | 5.8 | 2.4 | 2.1 | 12 |
| 53 | O | 2.3 | 84.2 | 4.8 | 5.9 | 2.5 | 2.3 | 13 |
| 54 | P | 2.6 | 84.1 | 3.9 | 6.4 | 1.9 | 1.8 | 14 |

| No. | Average grain diameter of retained γ (μm) | TS (MPa) | El (%) | λ (%) | TS × El (MPa · %) | r value | LDR | Remarks |
|---|---|---|---|---|---|---|---|---|
| 39 | 0.7 | 611 | 35.6 | 120 | 21752 | 1.01 | 2.12 | Invention example |
| 40 | 1.0 | 628 | 35.9 | 96 | 22545 | 0.99 | 2.15 | Invention example |
| 41 | 0.6 | 614 | 34.8 | 116 | 21367 | 0.98 | 2.12 | Invention example |
| 42 | 0.5 | 610 | 34.1 | 111 | 20801 | 1.00 | 2.12 | Invention example |
| 43 | 0.4 | 598 | 30.4 | 89 | 18179 | 0.98 | 2.06 | Comparative example |
| 44 | 0.6 | 600 | 30.1 | 88 | 18060 | 0.98 | 2.09 | Comparative example |
| 45 | 0.8 | 610 | 36.0 | 122 | 21960 | 1.00 | 2.12 | Invention example |
| 46 | 0.9 | 612 | 34.8 | 116 | 21298 | 0.99 | 2.12 | Invention example |
| 47 | 1.2 | 640 | 32.4 | 68 | 20736 | 0.98 | 2.06 | Comparative example |
| 48 | 0.9 | 621 | 33.4 | 103 | 20741 | 0.99 | 2.12 | Invention example |
| 49 | 1.0 | 612 | 36.0 | 124 | 22032 | 0.98 | 2.12 | Invention example |
| 50 | 0.6 | 618 | 33.8 | 112 | 20888 | 0.97 | 2.15 | Invention example |
| 51 | 0.7 | 610 | 34.3 | 99 | 20923 | 0.99 | 2.12 | Invention example |
| 52 | 0.8 | 630 | 33.2 | 129 | 20916 | 1.01 | 2.15 | Invention example |
| 53 | 0.9 | 614 | 34.5 | 118 | 21183 | 1.00 | 2.12 | Invention example |
| 54 | 1.0 | 608 | 35.5 | 116 | 21584 | 0.98 | 2.12 | Invention example |

Underlined portion: out of the scope of the present invention.

α: ferrite, B: bainite, P: pearlite, M: martensite, γ: austenite

Every high strength galvanized steel sheet according to the present invention preferably has TS of 590 MPa and exhibits excellent elongation and stretch flangeability. Furthermore, TS×El≥20,000 MPa·% and the balance between the strength and the elongation is high. Therefore, it is clear that high strength galvanized steel sheet with excellent workability is obtained. On the other hand, regarding comparative examples, at least one of the strength, the elongation, and the stretch flangeability is poor.

The invention claimed is:

1. A high strength galvanized steel sheet comprising a component composition containing C: 0.04% or more, and 0.15% or less, Si: 0.7% or more, and 2.3% or less, Mn: 0.8% or more, and 2.2% or less, P: 0.1% or less, S: 0.01% or less, Al: 0.1% or less, N: 0.008% or less, and the remainder composed of iron and incidental impurities on a percent by mass basis, and a microstructure including 70% or more of ferrite phase, 2% or more, and 10% or less of bainite phase, and 2% or more, and 12% or less of pearlite phase on an area fraction basis and 1% or more, and 8% or less of retained austenite phase on a volume fraction basis, wherein an average crystal grain diameter of ferrite is 18 μm or less and an average crystal grain diameter of retained austenite is 2 μm or less, and wherein the high strength galvanized steel sheet further comprises 1% or more, and 5% or less of martensitic phase on an area fraction basis.

2. The high strength galvanized steel sheet according to claim 1, further comprising at least one type of element selected from Cr: 0.05% or more, and 1.2% or less, V: 0.005% or more, and 1.0% or less, and Mo: 0.005% or more, and 0.5% or less, on a percent by mass basis, as the component composition.

3. The high strength galvanized steel sheet according to claim 1, further comprising at least one type of element selected from Ti: 0.01% or more, and 0.1% or less, Nb: 0.01% or more, and 0.1% or less, B: 0.0003% or more, and 0.0050% or less, Ni: 0.05% or more, and 2.0% or less, and Cu: 0.05% or more, and 2.0% or less, on a percent by mass basis, as the component composition.

4. The high strength galvanized steel sheet according to claim 1, further comprising at least one type of element selected from Ca: 0.001% or more, and 0.005% or less and rare earth metals (REM): 0.001% or more, and 0.005% or less, on a percent by mass basis, as the component composition.

5. The high strength galvanized steel sheet according to claim 1, wherein the zinc coating is an alloyed zinc coating.

6. A method for manufacturing a high strength galvanized steel sheet comprising the steps of subjecting a steel slab having the component composition according to claim 1 to hot rolling, pickling, and cold rolling, performing heating to a temperature range of 650° C. or higher at an average heating rate of 8° C./s or more, followed by keeping in a temperature range of 750° C. to 900° C. for 15 to 600 s, performing cooling to a temperature range of 300° C. to 550° C. at an average cooling rate of 3° C./s to 80° C./s, followed by keeping in the temperature range of 300° C. to 550° C. for 10 to 200 s, and performing galvanization.

7. A method for manufacturing a high strength galvanized steel sheet comprising the steps of subjecting a steel slab having the component composition according to claim 1 to hot rolling and pickling, performing heating to a temperature range of 650° C. or higher at an average heating rate of 8° C./s or more, followed by keeping in a temperature range of 750° C. to 900° C. for 15 to 600 s, performing cooling to a temperature range of 300° C. to 550° C. at an average cooling rate of 3° C./s to 80° C./s, followed by keeping in the temperature range of 300° C. to 550° C. for 10 to 200 s, and performing galvanization.

8. The method for manufacturing a high strength galvanized steel sheet according to claim 6, wherin an alloying treatment of zinc coating is performed in a temperature range of 520° C. to 600° C. after the galvanization is performed.

9. The method for manufacturing a high strength galvanized steel sheet according to claim 7, wherein an alloying treatment of zinc coating is performed in a temperature range of 520° C. to 600° C. after the galvanization is performed.

* * * * *